US010401779B2

(12) United States Patent
Katagiri et al.

(10) Patent No.: US 10,401,779 B2
(45) Date of Patent: Sep. 3, 2019

(54) IMAGE FORMING APPARATUS

(71) Applicant: CANON KABUSHIKI KAISHA, Tokyo (JP)

(72) Inventors: Shinji Katagiri, Yokohama (JP); Tsuguhiro Yoshida, Yokohama (JP); Shuichi Tetsuno, Kawasaki (JP); Takayuki Tanaka, Tokyo (JP); Takahiro Ikeda, Oyama (JP); Satoru Motohashi, Kashiwa (JP); Takumi Furukawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/054,676

(22) Filed: Aug. 3, 2018

(65) Prior Publication Data

US 2019/0064726 A1 Feb. 28, 2019

(30) Foreign Application Priority Data

Aug. 28, 2017 (JP) ..... 2017-163744

(51) Int. Cl.

| | |
|---|---|
| ***G03G 15/08*** | (2006.01) |
| ***G03G 21/00*** | (2006.01) |
| ***G03G 15/00*** | (2006.01) |
| ***G03G 15/01*** | (2006.01) |
| ***G03G 15/02*** | (2006.01) |
| *G03G 15/16* | (2006.01) |

(52) U.S. Cl.

CPC ..... *G03G 21/0064* (2013.01); *G03G 15/0121* (2013.01); *G03G 15/0126* (2013.01); *G03G 15/0131* (2013.01); *G03G 15/0189* (2013.01); *G03G 15/0233* (2013.01); *G03G 15/0808* (2013.01); *G03G 15/80* (2013.01); *G03G 15/0225* (2013.01); *G03G 15/161* (2013.01)

(58) Field of Classification Search

CPC ..... G03G 21/1853; G03G 2221/1654; G04G 15/0194; G04G 15/0233; G04G 15/08; G04G 15/161

See application file for complete search history.

(56) References Cited

U.S. PATENT DOCUMENTS

| | | | | |
|---|---|---|---|---|
| 8,532,534 | B2 * | 9/2013 | Taniguchi | G03G 15/0233 399/176 |
| 2016/0062259 | A1 * | 3/2016 | Miyagawa | G03G 15/0233 399/176 |
| 2018/0149993 | A1 * | 5/2018 | Tetsuno | G03G 15/0266 |

FOREIGN PATENT DOCUMENTS

| | | | |
|---|---|---|---|
| JP | 2002049232 | A | 2/2002 |
| JP | 2003255673 | A | 9/2003 |
| JP | 2004126202 | A | 4/2004 |
| JP | 2004233553 | A | 8/2004 |

* cited by examiner

*Primary Examiner* — Walter L Lindsay, Jr.
*Assistant Examiner* — Jessica L Eley
(74) *Attorney, Agent, or Firm* — Canon U.S.A., Inc. IP Division

(57) ABSTRACT

A charge roller includes, in a surface thereof, recesses that have sizes that are equivalent to or larger than a volume average particle diameter of a toner accommodated in a developing unit and that are capable of collecting the toner retransferred to a photosensitive drum.

14 Claims, 10 Drawing Sheets

IMAGE FORMING APPARATUS

BACKGROUND OF THE INVENTION

Field of the Invention

The present disclosure relates to a color image forming apparatus using an electrophotographic process or the like.

Description of the Related Art

As an electrophotographic system image forming apparatus, configuration of a tandem type image forming apparatus in which a plurality of image forming units are arranged in a moving direction of a belt, such as a conveying belt or an intermediate transfer belt, is known. Each of the image forming unit of various colors includes a drum-shaped photosensitive member (hereinafter, referred to as a photosensitive drum) serving as an image bearing member. Toner images of various colors carried on each of the photosensitive drums of various colors are transferred onto a transfer material, such as a sheet of paper or an OHP sheet, conveyed by a transfer material conveying belt, or after once being transferred to the intermediate transfer belt and then being transferred to a transfer material are fixed to a transfer material with a fixing unit.

Japanese Patent Laid-Open No. 2004-126202 discloses a configuration (hereinafter, referred to as a "cleanerless configuration") that is not provided with a cleaning unit that collects toner (residual toner) remaining on the photosensitive drum after transfer of toner images from the photosensitive drums of various colors to the transfer material of the intermediate transfer belt has been completed. In such a cleanerless configuration, the residual toner is collected by the developing unit while the toner moves along with the rotation of the photosensitive drum so that the toner is removed from the photosensitive drum and the photosensitive drum is cleaned.

However, in the configuration in Japanese Patent Laid-Open No. 2004-126202, the toner that has been transferred from a photosensitive drum disposed upstream in a moving direction of the belt to the transfer material or the intermediate transfer belt may be transferred (retransferred) to a photosensitive drum disposed downstream. Specifically, when a polarity of the toner transferred from the photosensitive drum on the upstream side to the transfer material or the intermediate transfer belt becomes inverted by an electric charge generated between the photosensitive drum on the downstream side and the belt, the polarity inverted toner is drawn to the photosensitive drum on the downstream side in an electrostatic manner and is retransferred.

In a cleanerless configuration, a cleaning unit that collects toner is not separately provided in each of the photosensitive drum of various colors; accordingly, the toner that has been retransferred to the photosensitive drum on the downstream side becomes adhered to the surface of the charge member that abuts against the photosensitive drum or is collected by the developing unit. In the above case, color mixing may occur in the image forming unit on the downstream side when toner of a different color is collected by the developing unit and, further, when toner adheres to the surface of the charge member, the charging performance of charging the photosensitive drum may become poor.

SUMMARY OF THE INVENTION

Accordingly, the present disclosure provides an image forming apparatus having a cleanerless configuration that is capable of suppressing color mixing from occurring and suppressing decrease in the charging performance of the charge member.

An image forming apparatus of the present disclosure includes a first image bearing member that carries a toner image, a movable belt that abuts against the first image bearing member to form a first transfer portion, a second image bearing member that is disposed downstream of the first image bearing member in the moving direction of the belt and that carries a toner image having a color different from that of the toner image carried on the first image bearing member, a charge member that charges the second image bearing member, and, a developing unit that develops an electrostatic latent image formed on the second bearing member with toner into a toner image. A second transfer portion is formed by abutting the second image bearing member and the belt against each other. In the image forming apparatus that is capable of collecting the toner that is charged to a first polarity that is a normal charge polarity of the toner and that remains on the second image bearing member after passing through the second transfer portion with the rotation of the second image bearing member, the charge member includes, in a surface thereof, recesses that have sizes that are equivalent to or larger than a volume average particle diameter of the toner accommodated on the developing unit, in which the recesses is capable of collecting toner that has moved to the second image bearing member at the second transfer portion after being transferred at the first transfer portion from the first image bearing member.

Further features and aspects of the disclosure will become apparent from the following description of numerous example embodiments with reference to the attached drawings.

DESCRIPTION OF THE EMBODIMENTS

Figure 1:
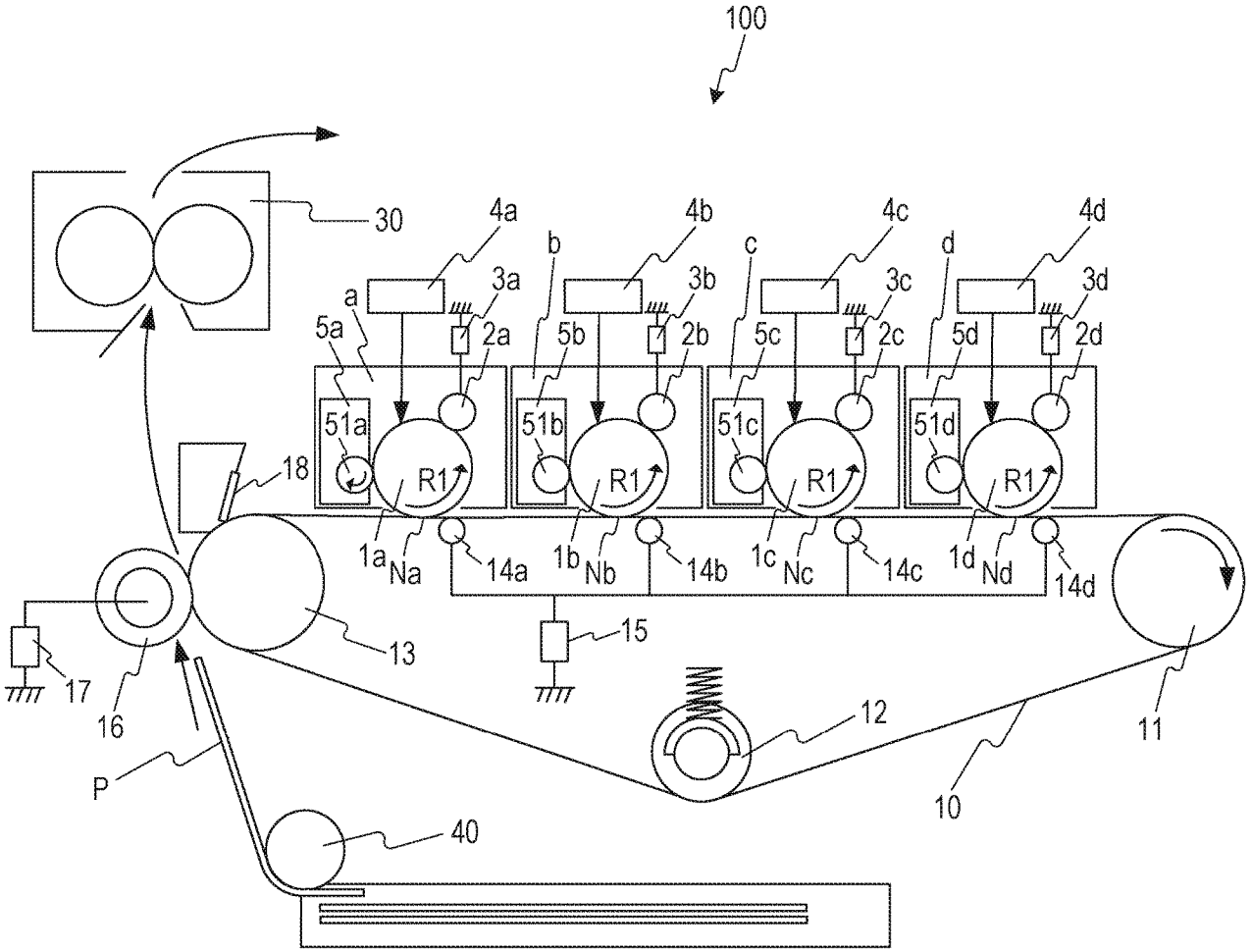
FIG. 1 is a schematic cross-sectional view illustrating a configuration of an image forming apparatus of a first embodiment.

Hereinafter, referring to the drawings, numerous embodiments of the present disclosure will be discussed in detail. Note that the dimensions, the materials, and the shapes of the components and the relative configuration of the components, and the like that are described in the following embodiments are to be appropriately changed based on the device, to which the present disclosure is applied, and various conditions. Accordingly, unless otherwise specified in particular, the present disclosure is not to be limited by the embodiments described below.

First Example Embodiment

Configuration of Example Image Forming Apparatus

FIG. 1 is a cross-sectional view schematically illustrating a configuration of an image forming apparatus 100 according to the present embodiment. As illustrated in FIG. 1, the image forming apparatus 100 of the present embodiment is a so-called tandem type image forming apparatus provided with a plurality of image forming units a to d. An image is formed with toner of various colors and the first image forming unit a forms an image with yellow (Y) toner, the second image forming unit b with magenta (NI) toner, the third image forming unit c with cyan (C) toner, and the fourth image forming unit d with black (Bk) toner. The four image forming units are disposed in a line at constant intervals. Other than the color of the toner, the image forming units are configured with many portions that are practically the same. Accordingly, the image forming apparatus of the present embodiment will be described hereinafter using the first image forming unit a.

The first image forming unit a includes a photosensitive drum 1*a* that is a drum-shaped photosensitive member, a charge roller 2*a* that is a charge member, a charge power supply 3*a* that applies a voltage to the charge roller 2*a*, an exposure unit 4*a*, and a developing unit 5*a*. The photosensitive drum 1*a* is an image bearing member that carries a toner image and, receiving driving force from a drive source (not shown), is rotationally driven in an arrow R1-direction (counterclockwise) illustrated in the drawing at a predetermined circumferential velocity (a processing speed). Note that the image forming units a to d according to the present embodiment have a so-called cleanerless configuration in which no cleaning members abutting against the photosensitive drums 1*a* to 1*d* are provided.

By having a control unit (not shown) such as a controller receive an image signal, an image forming operation is started and the photosensitive drum 1*a* is rotationally driven. While the photosensitive drum 1*a* is being rotated, the charge roller 2*a* performs a charging process on the photosensitive drum 1*a* and uniformly charges the photosensitive drum 1*a* to a predetermined polarity (a negative polarity in the present embodiment) and to a predetermined charged potential, and the exposure unit 4*a* exposes the photosensitive drum 1*a* according to the image signal. With the above, an electrostatic latent image according to an image of the yellow component in the intended color image is formed. Subsequently, the electrostatic latent image is developed at a developing position with the developing unit 5*a* and is visualized on the photosensitive drum 1*a* as a yellow toner image. In the present embodiment, a normal charge polarity of the toner accommodated in the developing unit 5*a* is a negative polarity (a first polarity), and the electrostatic latent image is developed in a reversed manner with toner charged by the charge roller 2*a* so as to have the same charge polarity with that of the photosensitive drum 1*a*. However, not limited to the above, the present disclosure can be applied to an image forming apparatus that performs positive development of the electrostatic latent image with toner that has been charged to a positive polarity (a second polarity) opposite to the charge polarity of the photosensitive drum 1*a*.

The charge roller 2*a* serving as a charge member abuts against a surface of the photosensitive drum 1*a* and, by friction against the surface of the photosensitive drum 1*a*, is rotated so as to follow the rotation of the photosensitive drum 1*a*. Furthermore, the charge roller 2*a* is a roller member that is a metal core having a diameter of 5.5 mm provided with an elastic layer formed of a conductive elastic body having a thickness of 1.5 mm and a volume resistivity of about $1\times10^6$ Ωcm. The charge power supply 3*a* is connected to a metal shaft of the charge roller 2*a*, is controlled by the control unit (not shown), and applies, to the charge roller 2*a*, a predetermined voltage according to the image forming operation.

The potential of the surface of the photosensitive drum 1*a* when a voltage of −1100 [V] is applied to the charge roller 2*a* from the charge power supply 3*a* is about −500 [V] (measured with a surface electrometer, Model344, manufactured by Trek Inc.). Note that while in the present embodiment, charge power supplies 3*a* to 3*d* were provided for the image forming units a to d, respectively, not limited to the above, some of the image forming units may use a common charge power supply or all of the image forming units may use a common charge power supply.

The exposure unit 4*a* includes a laser driver, a laser diode, a polygon mirror, an optical system lens, and the like. The exposure unit 4*a* projects a laser beam on the basis of image information input from a host computer (not shown) to form an electrostatic latent image on the surface of the photosensitive drum 1*a*. In the present embodiment, the light quantity of the exposure unit 4*a* is adjusted so that a surface potential V1 of the photosensitive drum 1*a* is −100 [V] when a largest light quantity was exposed on the photosensitive drum 1*a* from the exposure unit 4*a*.

The developing unit 5*a* includes a development roller 51*a* serving as a developing member, and yellow toner. The developing unit 5*a* develops the electrostatic latent image formed on the photosensitive drum 1*a* into a toner image by supplying the toner to the photosensitive drum 1*a*. The development roller 51*a* is capable of being abutted against and separated from the photosensitive drum 1*a*, and supplies toner while being abutted against the photosensitive drum 1*a* with a predetermined abutment width. The development roller 51*a* rotates in a direction (a clockwise direction) opposite to the depicted arrow R1-direction at a circumferential velocity that is higher than a circumferential velocity of the photosensitive drum 1*a*.

A development roller power supply (not shown) is connected to the development rollers 51*a* to 51*d*, and a predetermined voltage (−300 [V] in the present embodiment) in accordance with the image forming operation is applied to the development rollers 51*a* to 51*d*. Note that in the present embodiment, a voltage is applied to the development rollers 51*a* to 51*d* of the image forming units a to d from a common development roller power supply; however, not limited to the above configuration, a common development roller power supply may be used in some of the image forming units or each of the development rollers 51*a* to 51*d* may be provided with a separate development roller power supply.

The toner in the present embodiment is nonmagnetic mono-component toner manufactured with a suspension polymerization method. The normal charge polarity of the nonmagnetic mono-component toner is negative and the volume average particle diameter is about 6.0 μm when measured with LS-230, a laser diffraction particle size distribution measuring device manufactured by Beckman Coulter, Inc. Furthermore, toner containing silicon oxide particles of about 1.5 wt % is adhered to the surface of the toner to improve the surface properties. The volume average particle diameter of the silicon oxide particles is about 20 nm. While toner manufactured with a suspension polymerization method is used in the present embodiment, not limited to such a method, toner manufactured with a pulverization method, or another polymerization method such as an emulsion polymerization method may be used, for example.

An intermediate transfer belt 10 serving as an intermediate transfer body is a movable and endless belt given conductivity by adding a conducting agent to a resin material. The intermediate transfer belt 10 is stretched across three shafts of stretching rollers 11, 12, and 13, and is rotationally driven at a circumferential velocity that is substantially the same as those of the photosensitive drums 1*a* to 1*d*. The intermediate transfer belt 10 abutting against the photosensitive drum 1*a* forms a primary transfer portion Na. The yellow toner image formed on the photosensitive drum 1*a* is primarily transferred from the photosensitive drum 1*a* to the intermediate transfer belt 10 in the course of passing through the primary transfer portion Na.

A metal roller 14*a* serving as a transfer member is provided on the inner peripheral surface side of the intermediate transfer belt 10 and at a position opposing the photosensitive drum 1*a* with the intermediate transfer belt 10 interposed therebetween. A primary transfer power supply 15 serving as a potential forming unit is connected to the metal roller 14*a*. The metal roller 14*a* is disposed downstream of the photosensitive drum 1*a* in a moving direction of the intermediate transfer belt 10. Furthermore, the metal roller 14*a* is constituted by a straight and cylindrical SUS rod plated with nickel having an outside diameter of 6 mm. The metal roller 14*a* is in contact with the intermediate transfer belt 10 across a predetermined area in a longitudinal direction that is orthogonal to the moving direction of the intermediate transfer belt 10, and is rotated so as to follow the rotation of the intermediate transfer belt 10.

The primary transfer power supply 15 applies a voltage of 500 [V] to the metal roller 14*a* according to the image forming operation. With the above, a charged potential is formed on the conductive intermediate transfer belt 10, and the yellow toner image is primarily transferred from the photosensitive drum 1*a* to the intermediate transfer belt 10. Note that in the present embodiment, while a common primary transfer power supply 15 applies a voltage to the metal rollers 14*a* to 14*d*, not limited to such a configuration, the metal rollers 14*a* to 14*d* may each be provided with a transfer power supply that applies a voltage or some of the metal rollers 14*a* to 14*d* may use a common transfer power supply.

Hereinafter, in a similar manner, a toner image formed of a second color, magenta, a toner image formed of a third color, cyan, and a toner image formed of a fourth color, black, are formed on the second, third, and fourth image forming units b to d, respectively, and are primarily transferred onto the intermediate transfer belt 10 in a sequential manner so as to overlap each other. With the above, a toner image including four colors corresponding to the intended color image is formed on the intermediate transfer belt 10. Subsequently, the four-colored toner image carried on the intermediate transfer belt 10 is secondarily transferred all at once onto a surface of a transfer material P, such as a sheet of paper or an OHT sheet, fed from a feed unit 40, in the course of passing through a secondary transfer portion formed by a secondary transfer offer 16 and the intermediate transfer belt 10 in contact with each other.

The secondary transfer roller 16 serving as a secondary transfer member uses a member that has an outside diameter of 18 mm in which a nickel plated steel bar having an outside diameter of 6 mm is covered with a foam sponge body, having as the main components NBR and epichlorohydrin rubber, adjusted to have a volume resistivity of $10^8$ Ω·cm and a thickness of 6 mm. Note that the rubber hardness of the foam sponge body is 30° (ASKER Durometer Type C). The secondary transfer roller 16 is in contact with an outer peripheral surface of the intermediate transfer belt 10, and forms the secondary transfer portion by pressing, at a pressure of about 50 N, an opposed roller 13 serving as an opposing member with the intermediate transfer belt 10 interposed therebetween. A secondary transfer power supply 17 is connected to the secondary transfer roller 16. By having the secondary transfer power supply 17 apply a voltage to the secondary transfer roller 16, the toner image is secondarily transferred to the transfer material P from the intermediate transfer belt 10 at the secondary transfer portion. Note that the secondary transfer power supply 17 is capable of outputting a voltage in the range of 100 to 4000 [V], In the present embodiment, a voltage of 2500 [V] is applied to secondarily transfer the toner image to the transfer material P from the intermediate transfer belt 10 at the secondary transfer portion.

The transfer material P to which the four-colored toner image carried on the intermediate transfer belt 10 has been transferred at the secondary transfer portion is, subsequently, introduced into a fixing unit 30 and is heated and compressed so that the toner of four colors is melted and mixed and is fixed to the transfer material R The toner remaining on the intermediate transfer belt 10 after the secondarily transfer is removed by the cleaning unit 18. The cleaning unit 18 is provided so as to oppose the opposed roller 13 with the intermediate transfer belt 10 in between, and is a collecting unit that collects the toner remaining on the intermediate transfer belt 10. Furthermore, the cleaning unit 18 includes a cleaning blade that is in contact with the outer peripheral surface of the intermediate transfer belt 10, and a waste toner container that accommodates toner that has been removed from the intermediate transfer belt 10 with the cleaning blade.

Note that the image forming apparatus 100 of the present embodiment is not provided with a contact member, which collects toner that has remained on the photosensitive drum 1*a* by having the contact member abut against the photosensitive drum 1*a*, in the portion between where the toner has passed through the primary transfer portion Na to where the toner reaches the charge unit to which the charge roller 2*a* and the photosensitive drum 1*a* are in contact. More specifically, it is a so-called cleanerless configuration that has no collecting member such as a cleaning blade that abuts against the photosensitive drum 1*a* in the portion between the primary transfer portion Na and the charge unit in the rotation direction of the photosensitive drum 1*a*. Accordingly, the residual toner remaining on the photosensitive drum 1*a* after the toner image has been primarily transferred from the photosensitive drum 1*a* to the intermediate transfer belt 10 is collected at the developing unit 5*a* after passing through the charge unit. In the above, the photosensitive drum 1*a* is charged and exposed once more with the charge roller 2*a* and the exposure unit 4*a* so that an electrostatic latent image according to image information is formed on the surface of the photosensitive drum 1*a*.

The residual toner that has reached the position where the developing unit 5*a* and the photosensitive drum 1*a* abut against each other almost has a negative polarity. Accordingly, some of the residual toner having a negative polarity is collected by the developing unit 5*a* with an electric field formed by a difference in the surface potential of the photosensitive drum 1*a* (unexposed portion −500 [V], exposed portion −100 [V]) and the voltage (−300 [V]) applied to the development roller 51*a*. In other words, in the unexposed portion, since the direction of the electric field is a direction in which the toner with a negative polarity is moved from the photosensitive drum 1*a* to the development roller 51*a*, the residual toner moves from the photosensitive drum 1*a* to the development roller 51*a* and is collected by the developing unit 5*a*.

On the other hand, the direction of the electric field in the exposed portion is a direction that moves the toner with a negative polarity from the development roller 51*a* to the photosensitive drum 1*a*; accordingly, the toner with a negative polarity carried by the development roller 51*a* moves to the photosensitive drum 1*a*, and a toner image is developed on the exposed portion of the photosensitive drum 1*a*. In so doing, the residual toner remaining on the photosensitive drum 1*a* is also used to develop the electrostatic latent image. As described above, the developing unit 5*a* of the present embodiment is capable of developing the electrostatic latent image formed on the photosensitive drum 1*a* and is also capable of collecting the toner with a negative polarity attached to the photosensitive drum 1*a*.

In the image forming apparatus of the present embodiment, a full color printed image is formed through the following operation.

Retransfer Toner

As is the case of the image forming apparatus 100, in a tandem image forming apparatus in which the plurality of photosensitive drums 1*a* to 1*d* carrying toner images of different colors are provided in the moving direction of the intermediate transfer belt 10, a phenomenon called retransfer occurs when using a cleanerless configuration. Note that retransfer is a phenomenon in which a toner image transferred from a photosensitive drum 1*a*, 1*b*, or 1*c* on the upstream side to the intermediate transfer belt 10 is moved to a photosensitive drum 1*b*, 1*c*, or 1*d* on the downstream side when passing through a position where the photosensitive drum 1*b*, 1*c*, or 1*d* on the downstream side and the intermediate transfer belt 10 come in contact with each other.

Figure 2A:
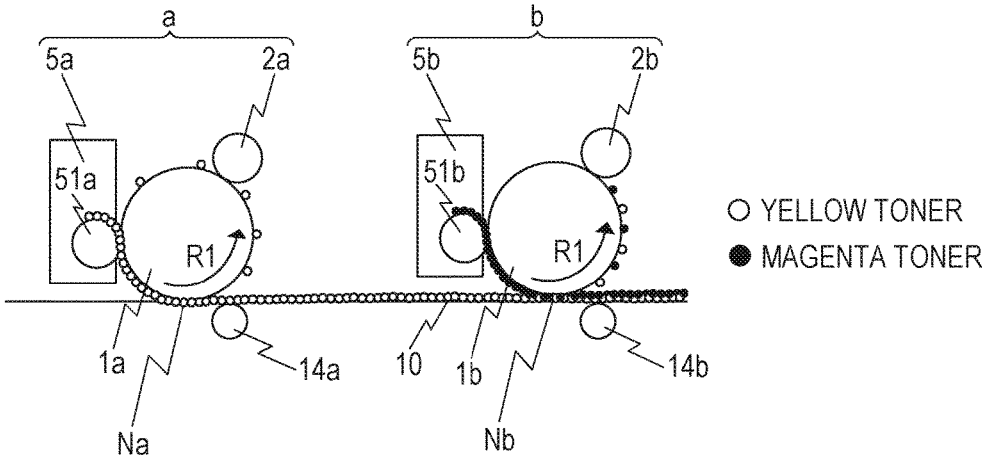
FIGS. 2A and 2B are schematic diagrams illustrating a mechanism in which retransfer occurs in the first embodiment, and a configuration collecting the retransferred toner.
Figure 2B:
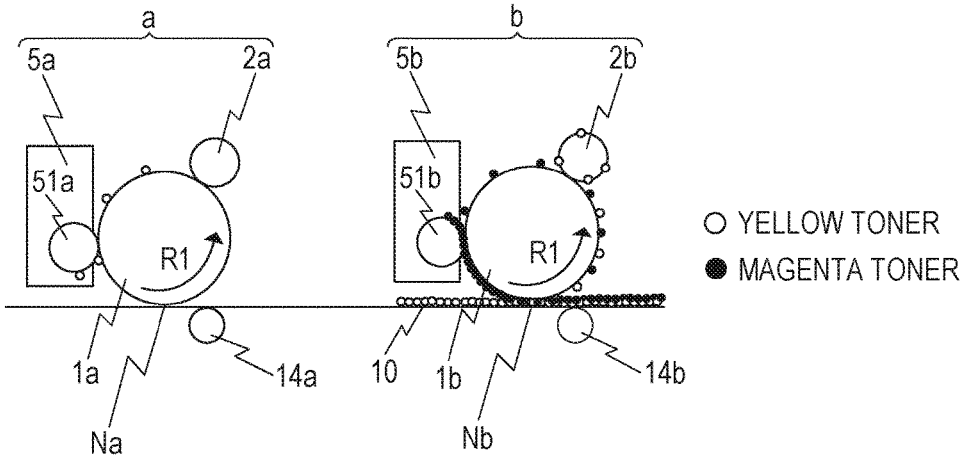

Hereinafter, a mechanism in which the retransfer occur and a configuration that collects the retransferred toner will be described using the image forming unit a, and the image forming unit b that is provided downstream of the image forming unit a in the moving direction of the intermediate transfer belt 10. FIG. 2A is a schematic diagram illustrating a mechanism in which the toner transferred to the intermediate transfer belt 10 from the photosensitive drum 1*a* (a first image bearing member) carrying a yellow (Y) toner image is retransferred to the photosensitive drum 1*b* (a second image bearing member) carrying a magenta (M) toner image. FIG. 2B is a schematic diagram illustrating the yellow toner that has been retransferred to the photosensitive drum 1*b* being collected by the charge roller 2*b*.

As illustrated in FIG. 2A, the yellow toner image that has been transferred from the photosensitive drum 1*a* to the intermediate transfer belt 10 at the primary transfer portion Na (a first transfer portion) reaches a primary transfer portion Nb (a second transfer portion) of the image forming unit b along with the movement of the intermediate transfer belt 10. In the primary transfer portion Nb, there are cases in which an electric discharge occurs due to the difference in the charged potential between the photosensitive drum 1*b* and the intermediate transfer belt 10, and when the yellow toner image transferred to the intermediate transfer belt 10 is charged by the above electric discharge, there are cases in which the charge polarity of the toner becomes inverted. In such a case, some of the toner in which the charge polarity has been inverted and that is charged to a positive polarity is, with the difference in the charged potentials between the intermediate transfer belt 10 and the photosensitive drum 1*b*, retransferred to the photosensitive drum 1*b* charged to a negative polarity.

When the yellow toner that has been retransferred from the intermediate transfer belt 10 to the photosensitive drum 1*b* is collected by a developing unit 5*b*, the yellow toner that has a color that is different from that of the magenta toner accommodated in the developing unit 5*b* become mixed and a color mixing may occur. Accordingly, in the present embodiment, as illustrated in FIG. 2B, the yellow toner that has been retransferred to from the intermediate transfer belt 10 to the photosensitive drum 1*b* at the primary transfer portion Nb is collected by the charge roller 2*b* to prevent color mixing from occurring.

Note that in the configuration in which the yellow toner that has been retransferred to the photosensitive drum 1*b* is collected by the charge roller 2*b*, the toner charged to a positive polarity is collected by the charge roller 2*b* every time the toner passes through the charge unit of the image forming unit b. In other words, at the image forming operation is repeated, the toner collected by the charge roller 2*b* becomes accumulated.

When toner adheres to a surface of the charge roller 2*b*, the contact area between the photosensitive drum 1*b* and the charge roller 2*b* changes and, accordingly, charging performance of the charge roller 2*b* charging the photosensitive drum 1*b* changes. With the above, the surface potential formed on the photosensitive drum 1*b* changes causing unevenness in the image density such that an image defect is brought about. Accordingly, in the present embodiment, by configuring the charge rollers 2*a* to 2*d* to have, in the surfaces thereof, recesses with sizes that are the same or larger than the volume average particle diameter of the toner, occurrence of color mixing is suppressed while a decrease in the charging performance of the charge member is suppressed.

Configuration of Charge Member

Configuration of the charge rollers 2*a* to 2*d* of the present embodiment will be described next with reference to FIGS. 3A and 3B. Note that since the configurations of the charge rollers 2*a* to 2*d* are the same, the charge rollers 2*a* to 2*d* will be collectively referred to as a charge roller 2 in the following description.

Figure 3A:
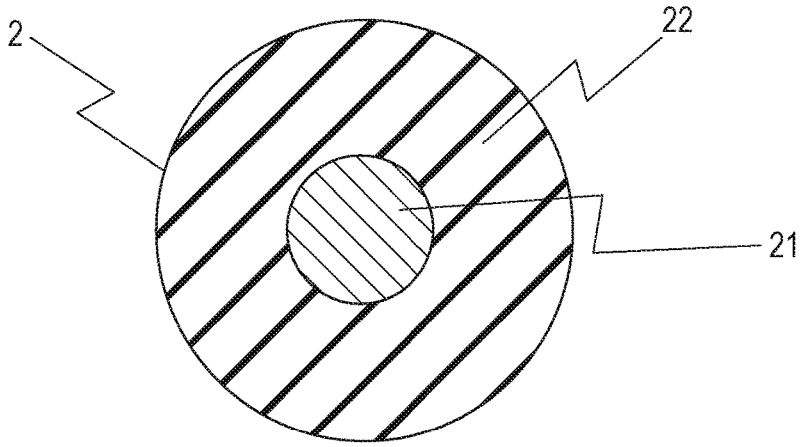
FIGS. 3A and 3B are diagrams schematically illustrating a configuration of a charge member of the first embodiment.
Figure 3B:
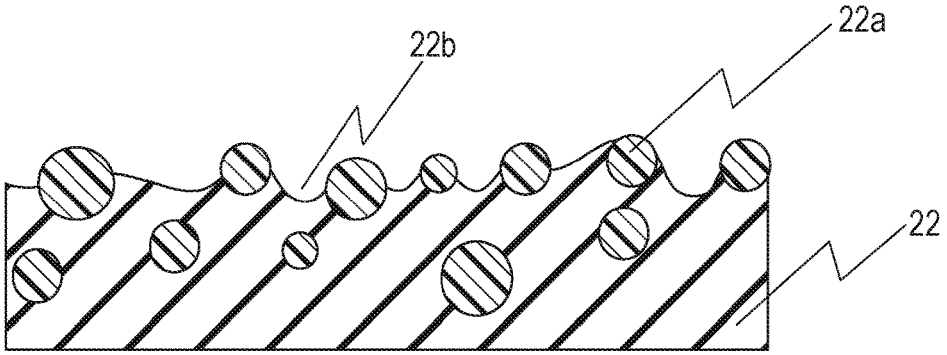

FIG. 3A is a schematic cross-sectional view of the charge roller 2 serving as the charging member of the present embodiment, and FIG. 3B is a schematic diagram schematically illustrating a surface profile of the charge roller 2. As illustrated in FIG. 3A, the charge roller 2 includes a metal core 21 and an elastic layer 22 formed on the surface of the metal core 21. Furthermore, as illustrated in FIG. 3B, the elastic layer 22 includes spherical particles 22*a*, and recesses 22*b* formed on the surface of the elastic layer 22 that has been turned into a rough surface by the spherical particles 22*a*. Note that the metal core 21 may be any member that is conductive, is capable of supporting the elastic layer 22, and is capable of maintaining the strength of the charge roller 2.

Subsequently, an outline of an example method of manufacturing the charge roller 2 will be described.

First, a conductive rubber composition that constitutes the elastic layer 22, and an unvulcanized rubber composition, which includes the spherical particles 22*a*, for making the surface of the elastic layer 22 rough are prepared. Resin particles or thermally expandable micro capsule particles may be used as the spherical particles 22*a* that turn the surface of the elastic layer 22 rough, and in the present embodiment, particles having particle sizes that are larger than that of the toner are used. Note that in the present embodiment, the particle size of the spherical particles 22*a* is preferably is in the range of 6 μm to 30 μm, inclusive.

Furthermore, while the material of the resin particles is not limited to any material in particular, the resin particles are desirably spherical resin particles formed of at least one resin selected from a phenol resin, a silicone resin, a polyacrylonitrile resin, a polystyrene resin, a polyurethane resin, a nylon resin, a polyethylene resin, a polypropylene resin, and an acrylic resin, or are spherical inorganic fine particles formed of at least one inorganic substance selected from silica, alumina, and zirconia, for example.

Subsequently, in order to form a moderately roughened surface profile, molding is performed on the unvulcanized rubber composition using a cross head extrusion molding apparatus. A cross head extrusion molding apparatus is a molding machine in which a metal core 21 having a predetermined length and an unvulcanized rubber composition are sent in at the same time to extrude, from an outlet of the cross head, an unvulcanized rubber roller in which an unvulcanized rubber composition having a predetermined thickness is uniformly coated on an outer periphery of the metal core 21. The unvulcanized rubber composition molded with the cross head extrusion molding apparatus is molded so as to have a so-called crown shape in which an outside diameter of a middle portion in the longitudinal direction of the metal core 21 is larger than the outside diameters of the end portions. In the above case, spherical particles 22*a*, which are added to roughen the surface of the charge roller 2, are exposed on the surface of the unvulcanized rubber roller.

The unvulcanized rubber roller obtained in the above manner is heated through a heating process, such as vulcanization by hot-air oven with a geer oven or by vulcanization with far infrared radiation, so that a charge roller 2 is obtained. Note that surface treatment, such as heat treatment, ultraviolet irradiation treatment, or electron beam irradiation treatment, may be further performed on the roller surface obtained by performing heat treatment on the unvulcanized rubber roller, or the charge roller 2 may have a multilayered structure by having a protective layer be formed on the surface.

The charge roller 2 of the present embodiment included, in the surface thereof, the recesses 22*b* that have sizes that are equivalent to or larger than the volume average particle diameter of the toner. The surface profile was defined by the following Math 1 in which the values were measured in accordance with JIS B0671-2:2002.

$$Rpk+Rk \geq D \quad \text{(Math 1)}$$

Note that Rpk is a crest height of the projection on the surface of the charge roller 2, and Rk is a difference in levels of a core portion, D is the volume average particle diameter of the toner. The values Rpk and Rk were in accordance with JIS B0671-2:2002, and measurements were made under the following measurement condition using a surface roughness tester (SURFCORDER SE3400, manufactured by Kosaka Laboratory Ltd.).

Measurement Condition

Measuring instrument: surface roughness tester (product name: SURFCORDER SE3400, manufactured by Kosaka Laboratory Ltd.)

Measured length L: 8.0 mm

Cutoff wavelength λc: 0.8 mm

Measuring speed: 0.5 mm/sec

Figure 4:
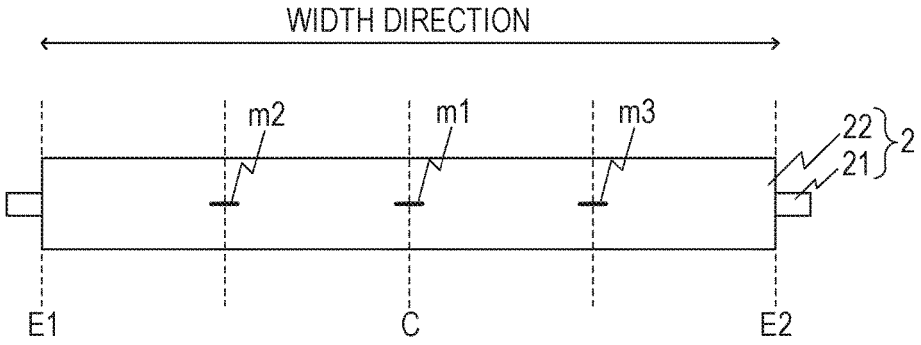
FIG. 4 is a schematic diagram illustrating positions where the surface profile of the charge member of the first embodiment is measured.

FIG. 4 is a schematic diagram for describing the measuring position when measuring the reduced peak height Rpk of the charge roller 2 and the core roughness depth Rk. As illustrated in FIG. 4, in the present example embodiment, surface profiles of three portions in the width direction of the metal core 21 were measured, the three portions being a measuring position m1 that is at a center portion C, a measuring position m2 between the center portion C and a first end portion E1, and a measuring position m3 between the center portion C and a second end portion E2. Furthermore, surface profiles at positions corresponding to the measuring positions m1 to m3 were measured at portions that are different from the three portions of the measuring positions m1 to m3 in the circumferential direction of the charge roller 2. Mean values of the values of the reduced peak height Rpk(μm) and the core roughness depth Rk (μm) were measured at six portions were referred to as the reduced peak height Rpk (μm) of the charge roller 2 and the core roughness depth Rk (μm) of the core portion. In the charge roller 2 of the present embodiment, the reduced peak height Rpk was 4.0 μm and the core roughness depth Rk was 8.5 μm. Since a volume average particle diameter D of the toner used in the present embodiment was 6.0 μm, the charge roller 2 satisfies Math 1.

Effectiveness and Advantages

In the present embodiment, while adhering the retransfer toner to the charge roller 2, a decrease in the charging performance of the charge roller 2 was suppressed with the charge roller 2 satisfying Math 1 described above. Hereinafter, effects and advantages of the present embodiment will be described in detail using comparative example 1 and comparative example 2. Note that in the present embodiment, comparative example 1, and comparative example 2, an image was formed with the circumferential velocity of the photosensitive drum 1 set to 100 mm/sec.

Comparative Example 1

Figure 5A:
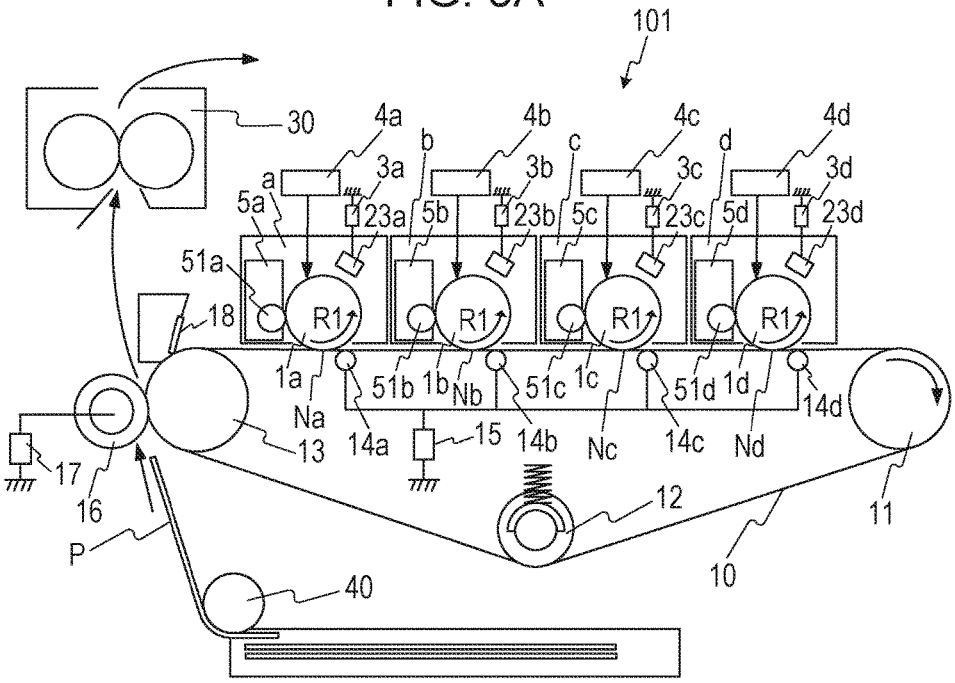
FIGS. 5A and 5B are schematic cross-sectional views illustrating configurations of image forming apparatuses of comparative example 1 and comparative example 2.

FIG. 5A is a cross-sectional view schematically illustrating a configuration of an image forming apparatus 101 of comparative example 1. As illustrated in FIG. 5A, in comparative example 1, corona chargers 23*a* to 23*d* that are noncontact charge members that charge the photosensitive drums 1*a* to 1*d* without contacting the photosensitive drums 1*a* to 1*d* were used. Note that since the configurations of the corona chargers 23*a* to 23*d* were the same in the image forming units a to d, the corona chargers 23*a* to 23*d* will be collectively referred to as a corona charger 23 in the following description.

The corona charger 23 was a scorotron-type discharge device that includes discharge electrodes (not shown) that perform electric discharge by having an electric current supplied thereto, a conductive shield (not shown), and a grid electrode (not shown). The control unit (not shown) such as a controller circuit controlled the voltage applied to the corona charger 23 so that a surface potential (a charged potential of the unexposed portion) of the photosensitive drum 1 during the image-forming period was −500 [V]. More specifically, the surface of the photosensitive drum 1 was charged while the control unit performed constant current control by feeding an electric current of −1000 μA to the discharge electrodes and controlled the DC voltage applied to the grid electrode to control the charging potential of the corona charger 23. Note that since other configurations of the image forming apparatus 101 of comparative example 1 are similar to those of the first embodiment, common components are attached with the same reference numerals as those of the first embodiment and description thereof is omitted.

Comparative Example 2

Figure 5B:
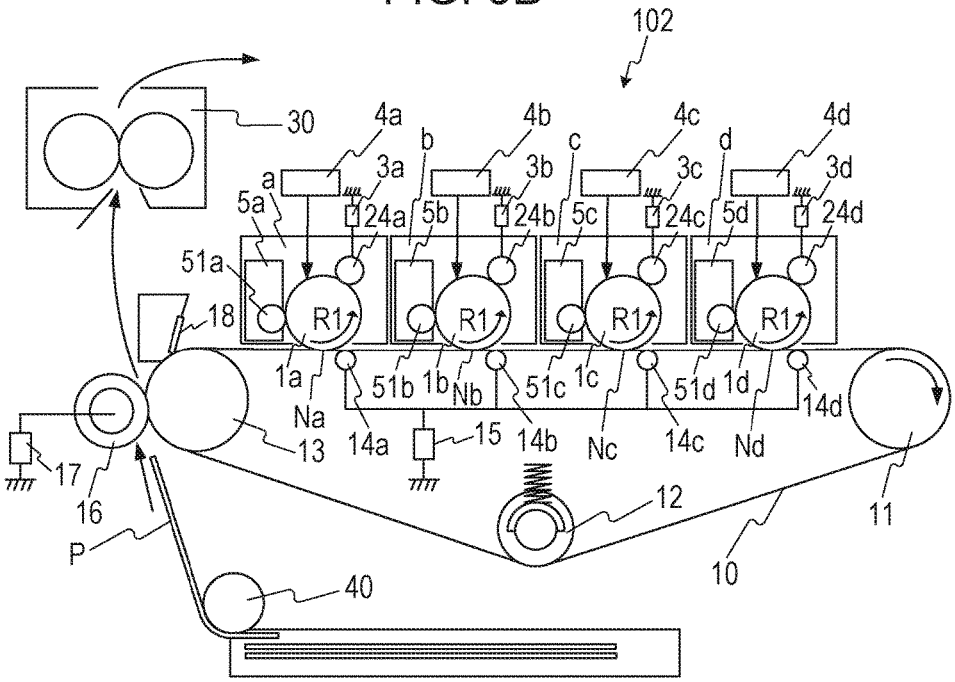

FIG. 5B is a cross-sectional view schematically illustrating a configuration of an image forming apparatus 102 of comparative example 2. As illustrated in FIG. 5B, in comparative example 2, charge rollers 24*a* to 24*d* that are contact charge members that come in contact with the photosensitive drums 1*a* to 1*d* and that have surface shapes that are different from those of the charge rollers 2*a* to 2*d* of the first embodiment were used. Note that since the configurations of the charge rollers 24*a* to 24*d* were the same in the image forming unit a to d, the charge rollers 24*a* to 24*d* will be collectively referred to as a charge roller 24 in the following description.

The charge roller 24 did not contain spherical particles formed of resin particles or thermally expandable micro capsules for roughening the surface of the elastic layer. The reduced peak height Rpk was 1.5 μm and the core roughness depth Rk was 3.0 μm, which were measured with a similar measuring method as that of the first embodiment. It can be understood that, according to the measurement results, the charge roller 24 of comparative example 2 that has a surface profile that is different from that of the charge roller 2 of the first embodiment and that has no recessed and projected shapes formed on the surface did not satisfy Math 1 described above. Note that since other configurations of the image forming apparatus 102 of comparative example 2 are similar to those of the first embodiment, common components are attached with the same reference numerals as those of the first embodiment and description thereof is omitted.

TABLE 1

| | Color Difference ΔE |
|---|---|
| First Example Embodiment | 1.5 |
| Comparative Example 1 | 4.5 |

Table 1 is a table illustrating the measurement result of the color variation caused by color mixing in the case of the first embodiment and comparative example 1 when 5000 sheets of transfer materials P had been passed continuously. The color variation caused by color mixing was evaluated after measuring the color tone of the cyan (C) toner of the developing unit 5*c* assuming a case in which the yellow toner that has been retransferred to the photosensitive drum 1*c* in the primary transfer portion Nc of the image forming unit c is collected by the developing unit 5*c*. The reason why the evaluation of the color variation when the yellow toner was collected in the developing unit 5*c* accommodating the cyan toner was made was because the color variation is the largest when the yellow toner and the cyan toner are mixed and the effect on the image is large.

In measuring the color variation, Spectrolino manufactured by GretagMacbeth LLC was used to measure the color tone of the cyan toner accommodated in the developing unit 5*c* after 5000 sheets of transfer materials P had been continuously passed, and to measure the color tone of the cyan toner in which the color has not been mixed. Subsequently, the color difference ΔE between the above two color tones was calculated. Furthermore, evaluation was made with the reference being whether the value of the calculated color difference ΔE was 3 or smaller. This is because color difference ΔE≤3 is the class-A permissible tolerance that. Japan Color Research Institute has specified. In other words, color difference ΔE≤3 is a difference in color that humans can barely feel.

In the configuration of the comparative example 1, since charging of the surface of the photosensitive drum 1 is performed by using the noncontact corona charger 23, the retransfer toner retransferred to the photosensitive drum 1*c* of the image forming unit c receives an electric discharge having a negative polarity from the corona charger 23*c* when passing through the charge unit and is charged to a negative polarity. Furthermore, when the retransfer toner that has been charged to a negative polarity reaches the position where the development roller 51*c* of the developing unit 5*c* and the photosensitive drum 1*c* contact each other, the retransfer toner moves from the photosensitive drum 1*c* to the development roller 51*c* and is collected by the developing unit 5*c* in a manner similar to the residual toner. As a result, color mixing occurs in the developing unit 5*c* by having toner that has a color that is different from the cyan toner become mixed in the developing unit 5*c*. As illustrated in Table 1, the value of the color difference ΔE calculated in the configuration of the comparative example 1 was 4.5, which exceeded 3 which is the reference value.

Conversely, in the configuration of the first embodiment, the contact charge roller 2*c* in which the surface thereof is formed with recesses 22*b* that have the same size or a larger size than the volume average particle diameter of the toner was used. The retransfer toner that has been retransferred to the photosensitive drum 1*c* can be collected by the recesses 22*b* of the charge roller 2*c*. With the above, color mixing that occurs by the retransfer toner being collected in the developing unit 5*c* can be suppressed. As illustrated in Table 1, the value of the color difference ΔE calculated in the configuration of the first embodiment was 1.5, which is below 3 which is the reference value.

TABLE 2

| | Change in Surface Potential |
|---|---|
| First Embodiment | 5 [V] |
| Comparative Example 2 | 13 [V] |

Table 2 is a table illustrating the amount of change in the surface potential of the photosensitive drum 1*c* in the first embodiment and comparative example 2 before and after 5000 sheets of transfer materials P had been passed continuously. The surface potentials of the photosensitive drum 1*c* in the charge roller 2*c* of the first embodiment and the charge roller 24*c* of comparative example 2 before and after 5000 sheets of transfer materials P were continuously passed were measured, and the amount of changes in the surface potential of the photosensitive drum 1*c* were obtained by calculating the differences. When the surface potentials of the photosensitive drums 1*a* to 1*d* change, the charged potential of the unexposed portion and the charged potential of the exposed portion change during the developing; accordingly, variation in density occurs in the image. When the surface potential changes 10 v, the variation in the image density can be visually recognized by the human eyes, especially in the highlight area; accordingly, the reference value is set to 10 v. Note that the measurement of the surface potential of the photosensitive drum 1*c* was conducted using surface electrometer Model344 manufactured by Trek Inc.

In the first embodiment and the comparative example 2, since the contact charge members are used, the retransfer toner that has been retransferred to the photosensitive drum 1*c* is collected from the photosensitive drum 1*c* to the charge roller 2*c* or the charge roller 24*c* in the charge unit of the first embodiment or comparative example 2. With the above, as the image forming operation is repeated, accompanied with the rotation of the photosensitive drum 1*c*, the retransfer toner is collected and is accumulated in the charge roller 2*c* or the charge roller 24*c*.

Note that the charge roller 24 of comparative example 2 do not include spherical particles that roughen the surface of the elastic layer, and recesses that have the size equivalent to or larger than the volume average particle diameter of the toner are not formed in the surface. Accordingly, when the retransfer toner collected by the charge roller 24*c* becomes accumulated, the surface of the charge roller 24*c* becomes completely covered by the retransfer toner. With the above, since it will be difficult to sufficiently obtain an area where the photosensitive drum 1*c* and the charge roller 24*c* abut against each other, it will be difficult for the charge roller 24*c* to sufficiently charge the photosensitive drum 1*c*. As illustrated in Table 2, the amount of change in the surface potential of the photosensitive drum 1*c* in comparative example 2 was 13 [V], and was above the reference value 10 [V]. The above is because the surface potential of the photosensitive drum 1*c* has changed due to the decrease in the charging performance of the charge roller 24*c* caused by the accumulation of the retransfer toner in the charge roller 24*c*.

Conversely, in the configuration of the charge roller 2*c* of the first embodiment, the amount of change in the surface potential of the photosensitive drum 1*c* was 5 [V], and was below the reference value 10 [V]. The above is because the retransfer toner can be collected in the recesses 22*b* since the charge roller 2*c* of the first embodiment includes recesses 22*b* that has the size equivalent to or larger than the volume average particle diameter of the toner. With such a configuration, when the retransfer toner is collected, the retransfer toner is collected by the recesses 22*b* in the surface of the charge roller 2*c* and the area where the photosensitive drum 1*c* and the charge roller 2*c* abut against each other can be obtained sufficiently with the projections formed with the spherical particles 22*a*. As a result, compared with comparative example 2, the decrease in the charging performance of the charge roller 2*c* caused by accumulation of the retransfer roller on the surface of the charge roller 2*c* can be suppressed.

Note that in the configuration of comparative example 1, since the noncontact corona charger 23 is used, the retransfer toner cannot be collected with the charge member, and the surface potential of the photosensitive drum 1*c* does not change.

As described above, by forming the recesses 22*b* having sizes that are equivalent to or larger than the volume average particle diameter of the toner in the surface of the charge roller in the image forming apparatus 100 with a cleanerless configuration, the decrease in the charging performance of the charge roller 2 can be suppressed while occurrence of color mixing is suppressed.

Discharge of Retransfer Toner

Figure 6A:
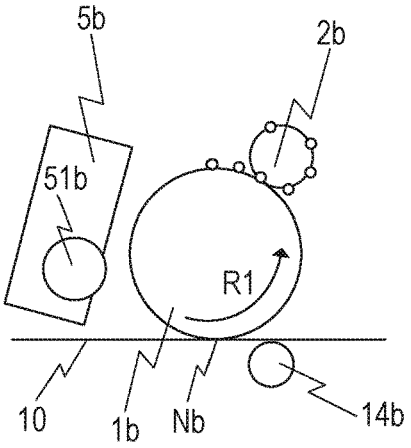
FIGS. 6A to 6C are schematic diagrams illustrating a discharge operation of retransfer toner, according to the first embodiment.
Figure 6B:
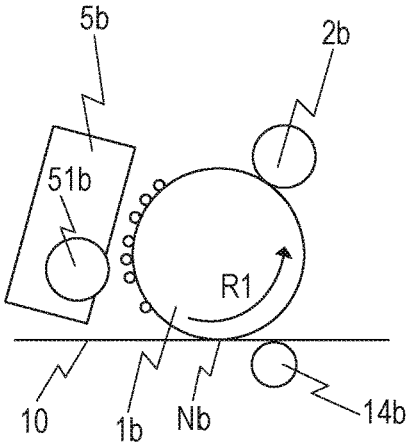
Figure 6C:
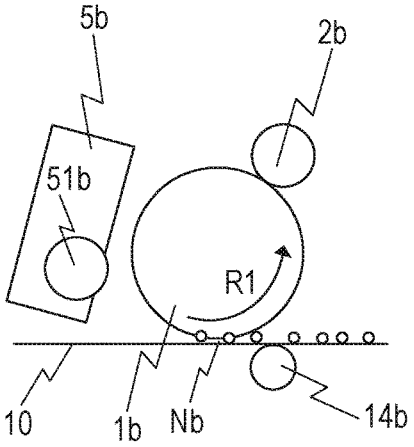
Figure 7:
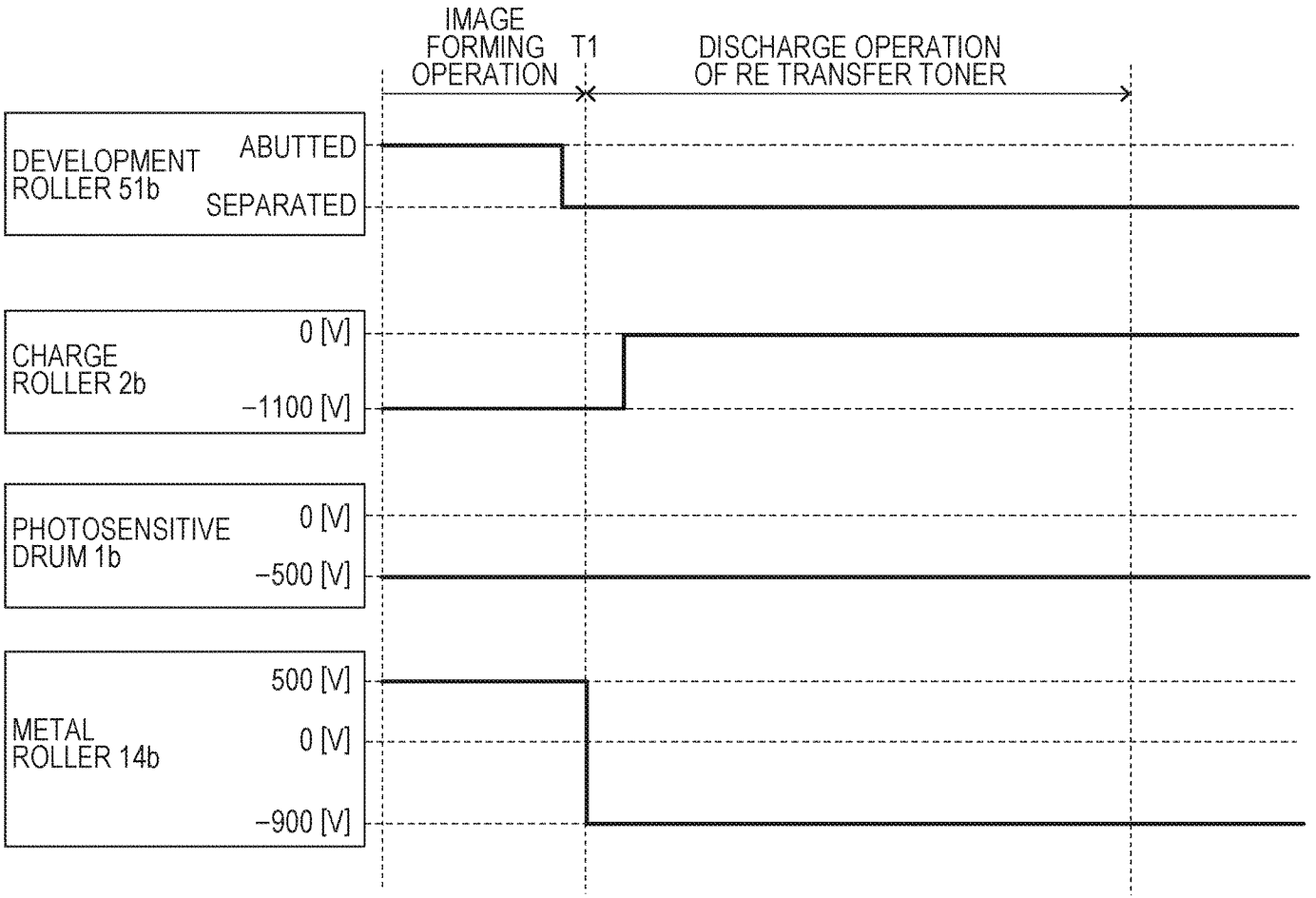
FIG. 7 is a diagram illustrating a sequence of a discharge operation of the retransfer toner, according to the first embodiment.

FIGS. 6A to 6C are schematic diagrams for describing an operation of discharging the retransfer toner (the yellow toner) collected by the charge roller 2*b* according to the present embodiment, and FIG. 7 is a diagram illustrating the sequence of discharging the retransfer toner from the charge roller 2*b*. In the present embodiment, in order to further suppress the decrease in the charging performance of the charge roller 2*b*, discharge of the retransfer toner collected by the charge roller 2*b* is performed at the timing when image forming operation is not performed, for example, at the post-rotation step and the like. Hereinafter, discharging of the retransfer toner will be described with reference to FIGS. 6A to 6C and 7.

As illustrated in FIG. 6A, the operation of discharging the retransfer toner from the charge roller 2*b* is started by, first, separating the development roller 51*b* from the photosensitive drum 1*b* after the development of the electrostatic latent image formed on the photosensitive drum 1*b* has been completed with the development roller 51*b*. Subsequently, as illustrated in FIG. 7, the voltage applied from the primary transfer power supply 15 to the metal roller 14*b* is switched at a time T1 when a rear end of the toner image transferred from the image forming unit a to d to the intermediate transfer belt 10 passes the primary transfer portion Nd of the image forming unit d on the lowermost-stream side. In the present embodiment, the voltage applied from the primary transfer power supply 15 to the metal roller 14*b* was switched from 500 [V] to −900 [V].

Subsequently, by switching the voltage applied to the charge roller 2*b* to 0 [V], the direction of the electric field formed between the charge roller 2*b* and the photosensitive drum 1*b* is turned to a direction opposite to the direction of the electric field formed during the image-forming period. Since the retransfer toner collected by the charge roller 2*b* is charged with a positive polarity, by forming an electric field to which the retransfer toner with a positive polarity is drawn from the charge roller 2*b* to the photosensitive drum 1*b* in an electrostatic manner, the retransfer toner collected by the charge roller 2*b* can be discharged.

The discharge start voltage between the charge roller 2*b* and the photosensitive drum 1*b* is to be Va [V]. In the above case, the voltage applied to the charge roller 2*b* when the retransfer toner is discharged is preferably a voltage in which the absolute value of the charged potential difference formed between the charge roller 2*b* and the photosensitive drum 1*b* is in a range of 100 [V] to Va [V], inclusive. When the absolute value of the charged potential difference formed between the charge roller 2*b* and the photosensitive drum 1*b* is below 100 [V], an electric field that is sufficiently strong to move the retransfer toner charged with a positive polarity from the charge roller 2*b* to the photosensitive drum 1*b* in an electrostatic manner is not formed. Furthermore, when the absolute value of the charged potential difference formed between the charge roller 2*b* and the photosensitive drum 1*b* is above Va [V], the polarity of the retransfer toner may become inverted due to an electric discharge occurring between the charge roller 2*b* and the photosensitive drum 1*b* and, accordingly, the retransferred toner may not be capable of being moved to the photosensitive drum 1*b* in an electrostatic manner.

The retransfer toner with a positive polarity discharged from the charge roller 2*b* to the photosensitive drum 1*b* is, subsequently, as illustrated in FIG. 6B, passes through the position where the developing unit 5*b* and the photosensitive drum 1*b* opposed each other. In so doing, since the development roller 51*b* is separated from the photosensitive drum 1*b*, the retransfer toner is not collected by the developing unit 5*b* and reaches the primary transfer portion Nb with the rotation of the photosensitive drum 1*b*.

In the primary transfer portion Nb, an electric field in which the current flows in the opposite direction to the direction of the current flowing through the primary transfer portion Nb during the image-forming period is formed with the charged potential difference between the surface potential (−500 [V]) of the photosensitive drum 1*b* and the voltage (−900 [V]) applied to the metal roller 14*b*. With the above, as illustrated in FIG. 6C, the retransfer toner charged with a positive polarity moves from the photosensitive drum 1*b* to the intermediate transfer belt 10*b* in an electrostatic manner. Subsequently, the retransfer toner that has moved to the intermediate transfer belt 10 passes through the secondary transfer portion with the movement of the intermediate transfer belt 10 and is removed by the cleaning unit 18.

In the present embodiment, a discharge operation of the retransfer toner collected by the charge roller 2*b* is performed with the following steps. Note that in the present embodiment, the voltage temporarily applied to the charge roller 2*b* when the retransfer toner is discharged is 0 [V]; however, as illustrated in FIG. 7, even if the voltage applied to the charge roller 2*b* is 0 [V], the surface potential of the photosensitive drum 1*b* scarcely changes.

A dark decay speed of the surface potential of the photosensitive drum 1*b* is about 1.3 V/sec, the diameter of the charge roller 2*b* is about 7.0 mm, the circumferential velocity of the photosensitive drum 1*b* is 100 mm/sec, the number of rotations of the charge roller 2*b* when the retransfer toner is discharged from the charge roller 2*b* is about one to three rotations. In other words, when the retransfer toner is discharged, the time in which the voltage applied to the charge roller 2*b* is 0 [V] is 1 second or shorter, or around 1 second. Accordingly, even if the voltage applied to the charge roller 2*b* is changed from −1100[V] to 0[V], the surface potential of the photosensitive drum 1*b* scarcely changes and the effect thereof is negligible.

Furthermore, in the present embodiment, when discharging the retransfer toner, the directions of the electric fields formed between the photosensitive drum 1*b* and the charge roller 2*b*, and between the photosensitive drum 1*b* and the metal roller 14*b* are set opposite to the directions of the electric fields formed during the image-forming period. Accordingly, the operation of discharging the retransfer toner from the charge roller 2*b* needs to be performed during the non-image-forming period that is a period when image formation is not performed, and in the present embodiment, the discharge operation of the retransfer toner is performed in the post-rotation step that is a step in which a process of completing the image forming operation is performed. However, not limited to the above, the discharge operation of the retransfer toner can be performed anytime during the non-image-forming period.

Furthermore, in order to suppress the decrease in the charging performance of the charge roller 2*b*, more desirably, the discharge operation is performed before a predetermined amount of retransfer toner accumulates on the charge roller 2*b*. In the present embodiment, when formation of an image is continuously performed, the discharge operation of the retransfer toner is performed after image formation has been performed continuously on 50 sheets of transfer materials P.

Note that in the description above, the retransfer toner collecting operation and the toner discharge operation using the image forming unit b has been described as an example; however, there is retransfer toner in the image forming units b to d excluding the image forming unit a on the uppermost-stream side in the moving direction of the intermediate transfer belt 10. Furthermore, by using the configuration of the charge roller 2 of the present embodiment, suppression of color mixing and suppression of the decrease in the charging performance can be performed in the above image forming units b to d as well.

Figure 8:
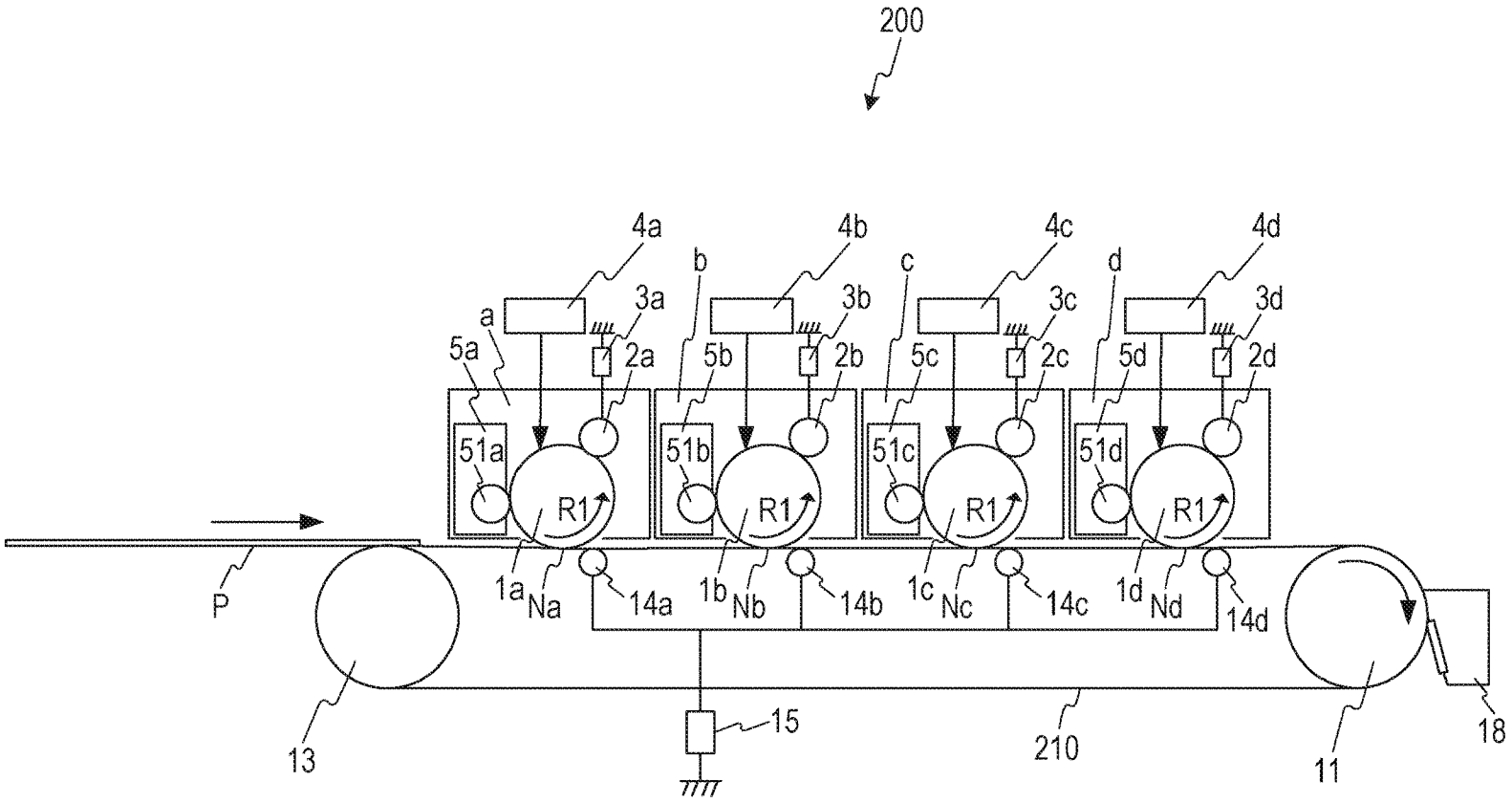
FIG. 8 is a diagram schematically illustrating an image forming apparatus that is a modification example of the first embodiment.

FIG. 8 is a schematic diagram illustrating a configuration of an image forming apparatus 200 serving as a modification example of the present embodiment. In the present embodiment, the image forming apparatus 100 of an intermediate transfer type using the intermediate transfer belt 10 has been described; however, not limited to the above, as illustrated in FIG. 8, by using the charge roller 2 of the present embodiment in an image forming apparatus 200 of a direct transfer type that includes a conveying belt 210 that conveys the transfer material P, an advantage similar to that of the present embodiment can be obtained.

Second Example Embodiment

Figure 9A:
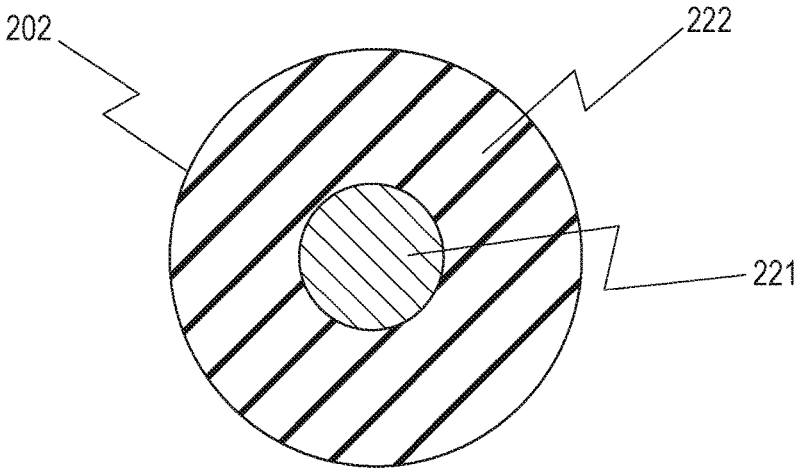
FIGS. 9A and 9B are diagrams schematically illustrating a configuration of a charge member of a second embodiment.
Figure 9B:
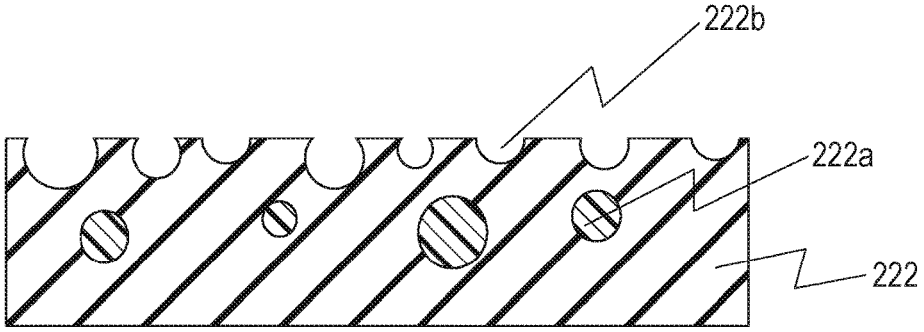

In the first embodiment, the configuration of the charge roller 2 formed, in the surface thereof, the recesses 22*b* having sizes that are equivalent to or larger than the volume average particle diameter of the toner by including spherical particles 22*a*, which are resin particles, in the elastic layer 22 of the charge roller 2 has been described. Conversely, as illustrated in FIGS. 9A and 9B, a second embodiment is different from the first embodiment in that spherical particles 222*a* that are thermally expandable micro capsule particles are contained in an elastic layer 222 of a charge roller 202. Note that other than the difference in the method of forming recesses 222*b* in the surface of the elastic layer 222 of the charge roller 202, the configuration of the second embodiment is similar to that of the first embodiment; accordingly, the same members and configurations will be attached with the same reference numerals and description thereof will be omitted.

FIG. 9A is a schematic cross-sectional view of the charge roller 202 serving as the charging member of the present embodiment, and FIG. 9B is a schematic diagram schematically illustrating a surface profile of the charge roller 202. As illustrated in FIG. 9A, the charge roller 202 includes a metal core 221 and an elastic layer 222 formed on the surface of the metal core 221. Furthermore, as illustrated in FIG. 9B, the elastic layer 222 includes spherical particles 222*a* that are thermally expandable micro capsule particles, and recesses 222*b* formed on the surface of the elastic layer 222 that has been turned into a rough surface by the spherical particles 222*a*. Note that the metal core 221 may be any member that is conductive, is capable of supporting the elastic layer 222, and is capable of maintaining the strength of the charge roller 202.

The thermally expandable micro capsule particles are particles that include core shell structures, and are resin shell materials with low gas permeability containing core materials that become vaporized by heat. By being heated to a predetermined temperature, thermally expandable micro capsule particles expand and become internally hollow balloon-shaped particles. In the present embodiment, thermally expandable micro capsule particles that become 6 μm to 30 μm, inclusive, in particle size after being expanded with heat were used as the spherical particles 222*a*.

The resin for the shell material of the thermally expandable micro capsule particles is preferably a resin that has low gas permeability selected from acrylonitrile resin, vinylidene chloride resin, methacrylonitrile resin, and the like. Furthermore, as the core material that is vaporized by being heated is preferably a substance that becomes gaseous at a temperature or a temperature below the softening point of the shell material, and hydrocarbon or the like in which the carbon number is around three to ten is preferably used. Note that the content of the spherical particles 222*a* is preferably in the range of 1 volume % to 30 volume % with respect to the conductive rubber composition constituting the elastic layer 222.

An overall example method of manufacturing the charge roller 202 will be described next.

First, a conductive rubber composition that constitutes the elastic layer 222, and an unvulcanized rubber composition, which includes the spherical particles 222*a*, for making the surface of the elastic layer 222 rough are prepared. Subsequently, similar to the first embodiment, in order to form a moderately roughened surface profile, molding is performed on the unvulcanized rubber composition using a cross head extrusion molding apparatus, and a unvulcanized rubber roller is obtained. In the above case, spherical particles 222*a*, which are added to roughen the surface of the charge roller 202, are exposed on the surface of the unvulcanized rubber roller.

Furthermore, by heating the unvulcanized rubber roller, vulcanized rubber roller having thermally expanded thermally expandable micro capsule particles is obtained. Subsequently; by grinding the surface of the vulcanized rubber roller, a charge roller 202 including recesses 222*b* resulting from the spaces formed in the elastic layer 222 by heat expanding the thermally expandable micro capsule particles is obtained.

Subsequently, similar to the first embodiment, values Rpk and Rk of the charge roller 202 of the present embodiment were measured in accordance with JIS B0671-2:2002 using the surface roughness tester (SURFCORDER SE3400, manufactured by Kosaka Laboratory Ltd.). As a result, the charge roller 202 of the present embodiment had a reduced peak height Rpk of 4.0 μm and a core roughness depth Rk of 5.0 μm. Similar to the charge roller 2 of the first embodiment, since a volume average particle diameter D of the toner used in the present embodiment was 6.0 μm, the charge roller 202 satisfies Math 1. Accordingly, the charge roller 202 of the present embodiment also includes recesses 222*b* that have sizes that are equivalent to or larger than the volume average particle diameter of the toner, and an advantage similar to that of the first embodiment can be obtained as well with the configuration of the present embodiment.

Third Embodiment

In the first embodiment, the configuration in which the recesses 22*b* are formed in the surface of the elastic layer 22 by containing the spherical particles 22*a* in the elastic layer 22 of the charge roller 2 has been described. Conversely, in a third embodiment, a configuration in which insulating spherical particles 22*a* are contained in the elastic layer 22 of the charge roller 2 will be described. Note that in the configuration of the present embodiment, other than the spherical particles 22*a* contained in the elastic layer 22 having an insulation property, the configuration is the same as that of the first embodiment, and the same members and configurations will be attached with the same reference numerals and description thereof will be omitted.

Similar to the first embodiment, the charge roller 2 of the present embodiment includes the metal core 21, and the elastic layer 22 formed on the surface of the metal core 21, and the elastic layer 22 includes insulating spherical particles 22*a*, and recesses 22*b* formed in the surface of the elastic layer 22 that has been turned into a rough surface by the spherical particles 22*a*. Insulating resin particles or insulating thermally expandable micro capsule particles may be used as the insulating spherical particles 22*a*.

Furthermore, regarding the charge roller 2 of the present embodiment, the same results as the charge roller 2 of the first embodiment were obtained when the values Rpk and Rk were measured in accordance with JIS B0671-2:2002 using the surface roughness tester (SURFCORDER SE3400, manufactured by Kosaka Laboratory Ltd.). In other words, in the charge roller 2 of the present embodiment, the reduced peak height Rpk was 4.0 μm, the core roughness depth Rk was 8.5 μm, and the volume average particle diameter D of the toner used in the present embodiment was 6.0 μm. The charge roller 2 satisfied Math 1. Accordingly, an advantage similar to that of the first embodiment can be obtained as well with the configuration of the present embodiment.

Being affected by the electric resistance of the toner itself, electric resistance of the charge roller 2 may change when the retransfer toner is collected with the charge roller 2. If the electric resistance of the charge roller 2 changes depending on the amount of the collected retransfer toner, the charging performance may change. In the present embodiment, a surface layer resistance of the charge roller 2 can be increased by using the charge roller 2 that includes the insulating spherical particles 22*a*. With the above, the variation in the electric resistance of the charge roller 2 caused by the retransfer toner can be suppressed and, as a result, change in the charging performance is suppressed and the surface of the photosensitive drum 1 can be charged uniformly while collecting the retransfer toner with the charge roller 2.

Fourth Embodiment

Figure 10:
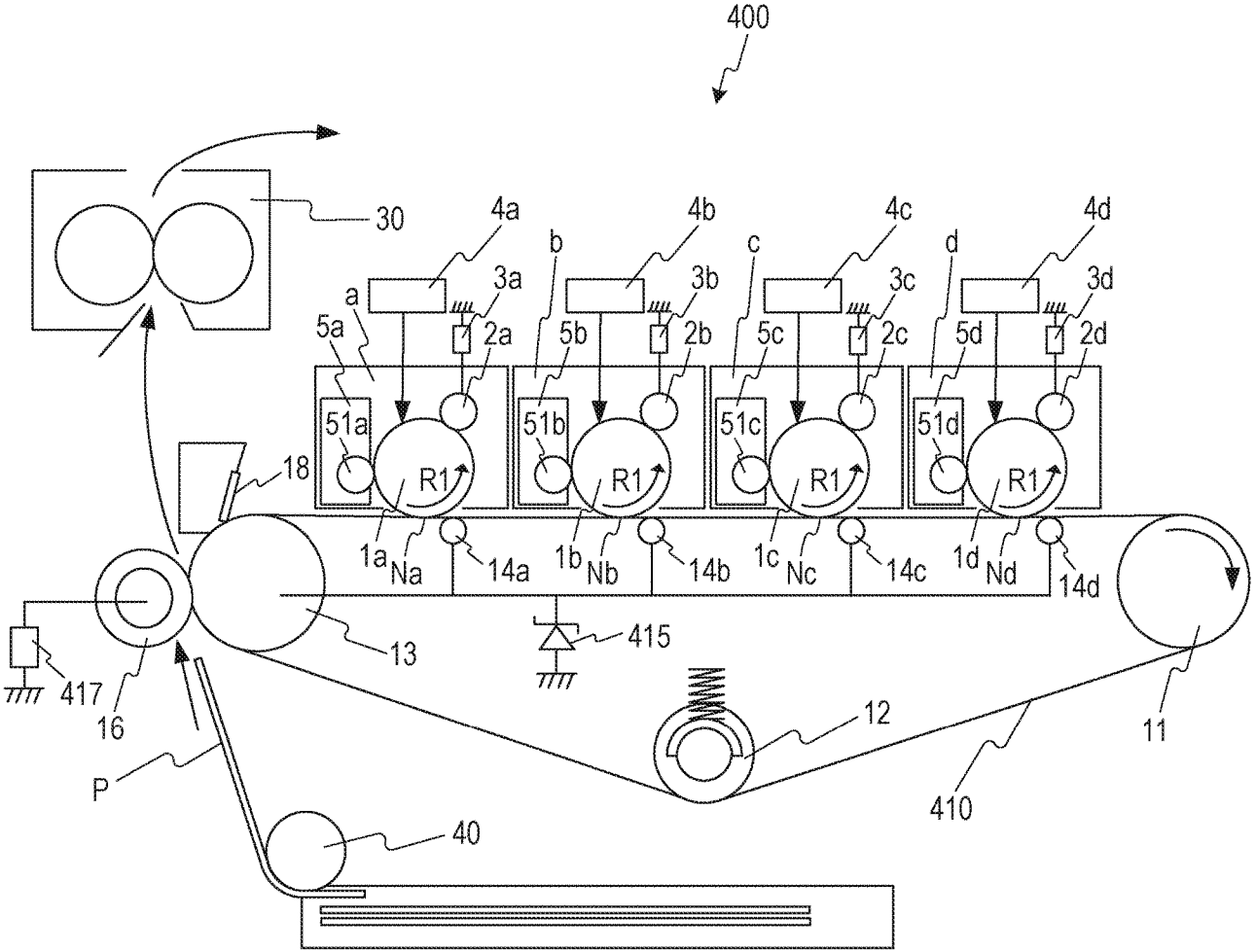
FIG. 10 is a schematic cross-sectional view illustrating a configuration of an image forming apparatus of a fourth embodiment.

In the first embodiment, a configuration in which toner images are primarily transferred to the intermediate transfer belt 10 from the photosensitive drums 1*a* to 1*d* by applying, from a common primary transfer power supply 15, a voltage to the metal rollers 14*a* to 14*d* provided so as to correspond to the image forming units a to d has been described. Conversely, as illustrated in FIG. 10, in an image forming apparatus 400 of a fourth embodiment, the primary transfer and the secondary transfer are performed with a transfer power supply 317 commonly used by the primary transfer power supply and the secondary transfer power supply of the image forming units a to d. Note that the configuration of the image forming apparatus 400 of the present embodiment is similar to that of the first embodiment other than that primary transfer is performed by applying a voltage from a transfer power supply 417 to the secondary transfer roller 16, and that a zener diode 415 serving as a constant voltage element is provided. Accordingly, members and configurations that are common with those of the first embodiment are denoted with the same reference numerals as those of the first embodiment and description thereof is omitted.

FIG. 10 is a cross-sectional view schematically illustrating a configuration of the image forming apparatus 400 according to the present embodiment. As illustrated in FIG. 10, the transfer power supply 417 is connected to the secondary transfer roller 16, and the secondary transfer roller 16 is electrically connected to the earth through an intermediate transfer belt 410, the opposed roller 13 serving as the opposing member, and the zener diode 415 serving as the constant voltage element. Furthermore, metal rollers 14 are electrically connected to the opposed roller 13 and are electrically connected to the earth through the zener diode 415.

The Zener diode 415 serving as the constant voltage element is an element that maintains a predetermined voltage (hereinafter, referred to as a breakdown voltage) by having an electric current flow therethrough, and generates a breakdown voltage to the cathode side when a specific amount of electric current or more flows. In the present embodiment, a cathode side (a first end side) of the zener diode 415 is connected to the opposed roller 13 and the metal rollers 14, and an anode side (a second end side) is electrically connected to the earth.

In the configuration of the present embodiment, when a voltage is applied from the transfer power supply 417 to the secondary transfer roller 16, electric current flows from the secondary transfer roller 16 to the zener diode 415 through the conductive intermediate transfer belt 410 and the opposed roller 13. In so doing, when an electric current of a predetermined value or higher flows to the zener diode 415, a breakdown voltage is generated in the cathode side of the zener diode 415, and the opposed roller 13 and the metal rollers 14 are maintained at the breakdown voltage of the zener diode 415. With the above, a primary transfer current flows from the metal rollers 14 to the photosensitive drums 1, and toner images are primarily transferred from the photosensitive drums 1 to the intermediate transfer belt 410.

As described above, even in the case of the present embodiment in which the primary transfer power supply and the secondary transfer power supply are commonly used, stable primarily transfer performance and stable secondary transfer performance can be obtained. With the above configuration, the primary transfer power supply can be reduced, and the power supply substrate can be simplified or reduced in size, and cost reduction can be achieved.

Note that in the present embodiment, in order to obtain a stable primarily transfer performance, an intermediate transfer belt that has a relatively low electric resistance, that is, a surface resistibility of $10^5$~$10^8$ Ω/□, is used as the intermediate transfer belt 410. Note that the surface resistivity is measured using Hiresta-UP (MCP-HT450) and a ring probe, type UR100 (model MCP-HTP16) manufactured by Mitsubishi Chemical Corporation. The measurement conditions are as follows: applied voltage 10 V; and the measurement time 10 seconds. The measurement is conducted under the following measurement environment: room temperature 23° C.; and room humidity 50%.

In the configuration of the present embodiment, when an electric current is fed to the intermediate transfer belt 410 to perform primary transferring, a uniform charged potential is formed on the intermediate transfer belt 410 having a lower electric resistance. With the above, an electric discharge (hereinafter, referred to as upstream electric discharge) is more easily generated upstream of the primary transfer portions N in the moving direction of the intermediate transfer belt 410 due to the charged potential difference between the photosensitive drums 1 and the intermediate transfer belt 410. With such an electric discharge, the charged potential of the photosensitive drum 1 at the primary transfer portion N where the photosensitive drum 1 and the intermediate transfer belt 410 abut against each other decreases, and generation of an electric discharge that inverts the polarity of the toner passing through the primary transfer portion N is suppressed. As a result, generation of the retransfer toner is suppressed.

According to the configuration of the present embodiment, generation of the retransfer toner can be suppressed; accordingly, the amount of retransfer toner collected by the charge roller 2 can be reduced. In other words, not only the advantage similar to that of the first embodiment can be obtained with the configuration of the present embodiment, an advantage such as being able to further suppress the occurrence of color mixing and decrease in the charging performance of the charge roller 2 can be obtained.

Note that in the present embodiment, the metal roller 14 and the opposed roller 13 are electrically connected to each other and electric current is made to flow from the metal roller 14 to the photosensitive drum 1 through the intermediate transfer belt 410. However, not limited to the above, a configuration in which an electric current is made to flow from the opposed roller 13 to the intermediate transfer belt 410 in the circumferential direction of the intermediate transfer belt 410 without providing the metal roller 14, and in which a toner image is transferred from the photosensitive drum 1 to the intermediate transfer belt 410 can also provide a similar advantage. In the above case, an electric current maintained at the breakdown voltage flow from the opposed roller 13 to the intermediate transfer belt 410 in the circumferential direction of the intermediate transfer belt 410.

While the disclosure has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2017-163744 filed Aug. 28, 2017, which is hereby incorporated by reference herein in its entirety.

What is claimed is:

1. An image forming apparatus comprising:

a movable belt;

a first image bearing member that abuts against the belt and that carries a toner image, a first transfer portion being formed at a position where the first image bearing member and the belt abut against each other;

a second image bearing member that is disposed downstream of the first image bearing member in a moving direction of the belt and that carries a toner image having a color different from the toner image carried on the first image bearing member, a second transfer portion being formed at a position where the second image bearing member and the belt abut against each other;

a developing member that develops an electrostatic latent image formed on the second image bearing member with toner into a toner image, the developing member being capable of collecting toner that is charged to a first polarity that is a normal charge polarity of the toner and that has remained on the second image bearing member after the toner has passed through the second transfer portion with a rotation of the second image bearing member; and a charge member that charges the second image bearing member, the charge member including, in a surface thereof, recesses that have sizes that are equivalent to or larger than a volume average particle diameter of the toner accommodated on the developing member, the recesses being capable of collecting toner that has born on the belt after transferring toner to the first image bearing member at the first transfer portion and moved to the second image bearing member from the belt at the second transfer portion.

2. The image forming apparatus according to claim 1, further comprising:

a power supply that applies a voltage having a first polarity to the charge member, wherein a voltage having a first polarity is applied from the power supply to the charge member so that the charge member, while charging the second image bearing member, collects the toner that has moved to the second image bearing member at the second transfer portion after being transferred at the first transfer portion from the first image bearing member.

3. The image forming apparatus according to claim 2, further comprising:

a first transfer member disposed so as to correspond to the first image bearing member and opposite the first image bearing member with the belt interposed therebetween, the first transfer member biasing the belt towards the first image bearing member to form the first transfer portion;

a second transfer member disposed so as to correspond to the second image bearing member and opposite the second image bearing member with the belt interposed therebetween, the second transfer member biasing the belt towards the second image bearing member to form the second transfer portion; and a transfer power supply that applies a voltage to the second transfer member, wherein an electric field in a direction in which the toner having the first polarity moves from the second image bearing member towards the belt is formed at the second transfer portion by applying, from the transfer power supply to the second transfer member, a voltage having a second polarity that is a polarity that is inverted with respect to the first polarity.

4. The image forming apparatus according to claim 3, wherein in the toner transferred from the first image bearing member at the first transfer portion, toner charged to a second polarity by receiving an electric discharge generated at the second transfer portion in a state in which a voltage of the second polarity has been applied to the second transfer member from the transfer power supply is collected by the charge member after moving to the second image bearing member at the second transfer portion.

5. The image forming apparatus according to claim 4, further comprising:

a collecting member that collects toner that has moved to the belt, wherein the developing member includes a developing member that is capable of abutting against and separating from the second image bearing member, and wherein during a non-image-forming period in which a toner image is not formed on the second image bearing member and in a state in which the developing member is separated from the second image bearing member, the collecting member collects toner that has been charged to the second polarity and that has moved from the second image bearing member to the belt at the second transfer portion after being moved from the charge member to the second image bearing member.

6. The image forming apparatus according to claim 5, wherein by applying a voltage having the first polarity from the transfer power supply to the second transfer member, the toner that has been moved from the charge member to the second image bearing member is moved from the second image bearing member to the belt at the second transfer portion.

7. The image forming apparatus according to claim 1, wherein a contact member that abuts against the second image bearing member at a portion between the second image bearing member and a position where the charge member and the second image bearing member are in contact with each other in a rotation direction of the second image bearing member is not provided.

8. The image forming apparatus according to claim 1, wherein the charge member is a roller member including an elastic layer in which a surface of the elastic layer includes spherical particles having sizes equivalent to or larger than the volume average particle diameter of the toner.

9. The image forming apparatus according to claim 8, wherein the spherical particles are insulating resin particles.

10. The image forming apparatus according to claim 1, wherein the charge member is a roller member including an elastic layer in which spaces having sizes that are equivalent to or larger than the volume average particle diameter of the toner are formed in a surface of the elastic layer by expansion of thermally expandable micro capsule particles.

11. The image forming apparatus according to claim 1, wherein the belt is an intermediate transfer belt, and wherein a toner images carried on the first image bearing member and the second image bearing member are secondarily transferred from the intermediate transfer belt to a transfer material after being primarily transferred from the first image bearing member and the second image bearing member to the intermediate transfer belt.

12. The image forming apparatus according to claim 11, further comprising:

a secondary transfer member that abuts against an outer peripheral surface of the intermediate transfer belt; and a transfer power supply that applies a voltage to the secondary transfer member, wherein by forming a charged potential on the intermediate transfer belt by applying a voltage from the transfer power supply to the secondary transfer member, toner images are primarily transferred from the first transfer portion and the second transfer portion to the intermediate transfer belt, and the toner images are secondarily transferred from the intermediate transfer belt to a transfer material at a position where the secondary transfer member and the intermediate transfer belt abut against each other.

13. The image forming apparatus according to claim 1, wherein the belt is a conveying belt that conveys a transfer material, and wherein toner images carried on the first image bearing member and the second image bearing member are sequentially transferred in an overlapping manner to a transfer material conveyed by the conveying belt.

14. The image forming apparatus according to claim 1, wherein a reduced peak height Rpk and a core roughness depth Rk obtained by measuring a surface profile of the charge member in accordance with MS B0671-2:2002 with a surface roughness tester complying with MS B0671-2:2002, and a volume average particle diameter of the toner D satisfy the following Math 1, $$Rpk+Rk \geq D \quad \text{(Math 1).}$$

* * * * *